US007483660B2

(12) United States Patent
Tazawa et al.

(10) Patent No.: US 7,483,660 B2
(45) Date of Patent: Jan. 27, 2009

(54) DEVELOPER SUPPLY CONTAINER

(75) Inventors: Fumio Tazawa, Abiko (JP); Toshiaki Nagashima, Moriya (JP); Nobuo Nakajima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/859,241

(22) Filed: Jun. 3, 2004

(65) Prior Publication Data

US 2005/0008400 A1 Jan. 13, 2005

(30) Foreign Application Priority Data

Jun. 3, 2003 (JP) ..... 2003/157721

(51) Int. Cl.
*G03G 15/08* (2006.01)

(52) U.S. Cl. ..... 399/263

(58) Field of Classification Search ..... 399/254, 399/263, 256, 258; 366/184, 187, 241, 279
See application file for complete search history.

(56) References Cited

U.S. PATENT DOCUMENTS

| | | | | |
|---|---|---|---|---|
| 6,185,401 | B1 | 2/2001 | Kanamori et al. | 399/262 |
| 6,421,517 | B1 * | 7/2002 | Nishino et al. | 399/254 |
| 6,438,345 | B1 | 8/2002 | Ban et al. | 399/262 |
| 6,456,810 | B1 * | 9/2002 | Deguchi et al. | 399/254 |
| 6,766,133 | B1 | 7/2004 | Ban et al. | 399/258 |
| 2001/0043826 | A1 * | 11/2001 | Mizoguchi et al. | 399/359 |
| 2002/0122676 | A1 | 9/2002 | Yamada et al. | 399/263 |
| 2004/0013445 | A1 | 1/2004 | Yamada et al. | 399/106 |

FOREIGN PATENT DOCUMENTS

| | | | |
|---|---|---|---|
| JP | 5-119616 | | 5/1993 |
| JP | 7-199621 | | 8/1995 |
| JP | 11-24401 | | 1/1999 |
| JP | 11-194600 | | 7/1999 |
| JP | 2002-40788 | | 2/2002 |
| JP | 2002156819 | A * | 5/2002 |
| JP | 2002214907 | A * | 7/2002 |

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

A developer supply container detachably mountable to an image forming apparatus, includes a container body, having a non-circular cross-section, for containing a developer, the container body having an arcuate portion and an extension upwardly extending from the arcuate portion; a discharge opening, formed in the arcuate portion for discharging the developer from the container body; a stirring member for stirring the developer in the container body, the stirring member having a rotation shaft provided in the arcuate portion and a flexible resin material sheet mounted on the rotation shaft; wherein the flexible resin material sheet includes a feeding blade for feeding the developer toward the discharge opening, the feeding blade being slidable relative to an inner surface of the arcuate portion and being non-slidable relative to a ceiling portion of an inner surface of the extension, and includes a stirring blade for stirring the developer, the stirring being slidable relative to a ceiling portion of the inner surface of the extension.

11 Claims, 10 Drawing Sheets

DEVELOPER SUPPLY CONTAINER

FIELD OF THE INVENTION AND RELATED ART

The present invention relates to a developer supply container employed by an electrophotographic or electrostatic image forming apparatus, for example, a copying machine, a printer, facsimile machine, etc.

Generally, an image forming apparatus such as an electrophotographic copying machine or a laser beam printer records an image through the following processes: a process in which a latent image is formed on the uniformly charge peripheral surface of the photosensitive drum by selectively exposing a numerous number of points of the uniformly charge area of the photosensitive drum; a process in which the latent image is developed by developer into an image formed of the developer (toner); and a process in which the developer (toner) image is transferred onto recording medium.

Thus, each time an image forming apparatus such as the one descried above runs out of developer, it must be supplied with developer. In order to supply an image forming apparatus, a developer supply container is employed. There are various developer supply containers, which can be roughly grouped into two types: a so-called "dumping type" developer supply container, that is, a developer supply container, from which the developer therein is delivered all at once into the developer container of the main assembly of an image forming apparatus; and a so-called "cartridge type" developer supply container, which is left in the main assembly of an image forming apparatus after its placement therein, and from which the developer therein is gradually delivered to the developing apparatus until it is depleted of the developer.

In recent years, from the standpoint of the contamination which occurs when supplying a developing apparatus with developer, and operability, a large number of the cartridge type developer supply containers have been proposed. Some of them are provided with a single or multiple stirring-conveying members, which are rotatably disposed in the container in the main assembly of an image forming apparatus, the stirring-conveying members can be rotated to convey the developer in the container, and discharge it from the container.

There are certain requirements which must be satisfied when designing the stirring member to be placed in a developer supply container. For example, there are the following requirements:

(1) A stirring member must be capable of quickly and reliably conveying developer to the opening of the developer outlet of a developer supply container, and discharge the developer through the opening, in response to the demand from the main assembly of an image forming apparatus.

(2) The stirring wing(s) of a stirring member must not frictionally produce developer particles larger in diameter (which hereinafter may be referred to as "coarse developer").

(3) A stirring member must be capable of minimizing the unextractable amount (which hereinafter may be referred to as "dead amount") of the developer in a developer supply container.

However, it is extremely difficult to design a stirring member which satisfies all of the above requirements. That is, in order to improve a stirring member in developer conveyance, in other words, in order to decrease the dead amount of the developer, it must be increased in the pressure it applies to developer. However, increasing the pressure a stirring member applied to developer increases the friction between the stirring member and developer, raising therefore the possibility that developer is frictionally turned into coarse developer. On the other hand, in order to reduce the possibility that developer is frictionally turned into coarse developer, a stirring member must be reduced in the friction it generates against developer, and in order to reduce the friction, it must be reduced in the pressure it applies to developer. However, decreasing the pressure a stirring member applies to developer results in the decrease in the developer conveying performance of the stirring member, which in turn increases the amount of the developer which cannot be extracted therefrom.

Thus, a developer supply container must be designed so that there is a proper balance between the developer conveying performance of a stirring member and the friction the stirring member generates against developer. As for the configuration of the container proper of a developer supply container, in order to make a developer supply container as uniform as possible in the friction between the stirring member and developer, in terms of its lengthwise direction as well as circumferential direction, the container proper of the developer supply container is desired to be uniform in the distance from the axial line of its stirring member to the internal surface of the container proper. In other words, the container proper of a developer supply container is desired to be roughly cylindrical (Patent Document 1).

In the case of the above-described roughly cylindrical developer supply container, the developer outlet virtually from one end of the developer supply container to the other in terms of the axial line of the stirring member thereof. There have been proposed improved versions of this developer supply container. For example, according to one (Patent Document 2) of the proposals, in order to improve the above-described developer container in spatial efficiency, that is, in order to make better use of the internal space of the main assembly of an image forming apparatus, the portion of the container proper, which is in the range in which the stirring member comes into contact with developer, is modified in the cross section perpendicular to the axial direction of stirring member. According to another (Patent Document 3) proposal, in order to improve the above-described developer container in terms of the contamination which occurs while supplying an image forming apparatus (developing apparatus) with developer, and also, in terms of operability, the opening of the developer outlet is made as small as possible to enable the stirring member to convey developer in the direction parallel with the axial line of the stirring member so that the developer is conveyed toward the opening of the developer outlet.

The above-mentioned proposals regarding a developer supply container definitely improve a developer supply container of the cartridge type, in terms of developer replenishment efficiency, and also in spatial efficiency, that is, the efficiency with which the internal space of the main assembly of an image forming apparatus is utilized. However, the market has been demanding further reduction in the size of an image forming apparatus, and in order to meet such a demand, it is desired to further improve a developer supply container in terms of spatial efficiency, so that the amount of the developer deliverable by a given developer supply container can be maximized without altering the external size of the developer supply container.

Under the above-described market condition, there have been occurring such situations that a developer supply container, the vertical dimension of which is extremely large relative to its dimension in terms of the direction perpendicular to the axial line of the stirring member is required. In the case of the above-mentioned developer supply container, there is the possibility that a certain amount of developer becomes stuck in the dead spaces, that is, the spaces which the stirring wings (flanges) of the stirring member do not reach, and/or remains adhered to the internal wall of the container proper, failing thereby to be stirred or conveyed; in other words, there is the possibility that a certain amount of developer permanently remains in the developer supply container. In order to prevent this problem, some measures had to be taken.

The following are the actually proposed countermeasures which can be taken to deal with the above-described problems. Some of them have been put to practical use.

1. Increase the rotational radius of a stirring-conveying wing (flange) of a stirring member so that they reach the dead space, that is, the space which cannot be reached by a stirring member with a smaller rotational radius (rotational axis of stirring member is not changed in position: it coincides with center of curvature of semicylindrical bottom portion of container proper).

2. Position the stirring member so that its rotational axis roughly coincides with the center of the longest chord of the cross section of the container proper, and extend the stirring-conveying wings (flanges) in terms of the direction perpendicular to the axial line of a stirring member.

3. Provide a developer supply container with an additional stirring member, which can reach the area of the container proper of the developer supply container, in which developer cannot be stirred nor conveyed by the primary stirring member (Patent Document 4).

4. Provide the flexible wings (flanges) of a stirring member with slits, creating thereby two groups of flexible wing portions different in flexibility so that one group of stirring wing portions sweeps the internal surface of the container proper, conveying thereby the developer, while the other group of stirring wing portions stirs the developer (Patent Document 5).

[Patent Documents]

Patent Document 1: Japanese Laid-open Patent Application 7-199621 (FIG. 4)

Patent Document 2: Japanese Laid-open Patent Application 11-194600 (FIGS. 9 and 23)

Patent Document 3: Japanese Laid-open Patent Application 11-24401 (FIG. 3)

Patent Document 4: Japanese Laid-open Patent Application 5-119616 (FIG. 3)

Patent Document 5: Japanese Laid-open Patent Application 2002-40788 (FIGS. 10, 13, and 14).

However, each of the stirring member structures disclosed in these patent documents also had its own problems.

In the case of the countermeasures 1 and 2, the scraping pressure (amount of theoretical entry) of the stirring wing becomes highest in the range which has little to do with the developer discharge and conveyance (range b in FIG. 5(B)). Thus, in order to make the stirring-conveying performance of the stirring member optimum (that is, highest within the range in which coarse developer is not produced) while the stirring wing is scraping the internal surface of the bottom portion (range a in FIG. 5(B) of the developer supply container, that is, where the stirring-conveying performance of the stirring member needs to be highest, the stirring member must be modified in structure to adjust the pressure applied to the internal surface of the container proper by the stirring member when the stirring member scrapes the internal surface of the container proper, so that the pressure (scraping pressure) between the stirring member and internal wall of the container proper becomes optimum while the stirring member is scraping the internal surface of the bottom portion of the developer supply container. However, making such a modification to the stirring member makes the contact pressure (scraping pressure) between the stirring member and the internal surface of the developer supply container even higher in the aforementioned range b, raising the risk of producing coarse developer. Thus, these countermeasures are not desirable.

In addition, the dimension of the stirring wing in terms of its rotational radius direction becomes too large relative to the dimension optimal for developer conveyance. In other words, the theoretical entry of the stirring wing into the internal wall of the container proper becomes too large, reducing thereby the stirring member in terms of the efficiency with which it conveys developer in its axial direction. Moreover, the state of the contact between the stirring wing and internal wall of the container proper become two dimensional, instead of being linear, raising the risk of making developer coarse.

Although Countermeasure 3 solves the problems that the employment of Countermeasures 1 and 2 creates, that is, the problems regarding the developer stirring-conveying performance of the stirring wings and the risk of producing coarse developer, it requires a very complicated mechanism, such as the one disclosed in Patent Document 4, substantially increasing the cost of a developer supply container. Further, the complicated mechanism itself possibly causes the formation of coarse developer, as it operates.

As the means for improving Countermeasure 3, instead of providing a developer supply container with the complicated internal mechanism, the developer supply container may be provided with two internal stirring members similar in structure, which are individually driven by the main assembly of an image forming apparatus. However, this structural arrangement also leads to the increase in the cost and size of the main assembly of an image forming apparatus, being therefore not the decisively desirable countermeasure.

The last countermeasure, or Countermeasure 4, which can inexpensively solve the above-described problems, makes it possible to optimize the flexibility of the stirring wings by adjusting the intervals at which the stirring wing is slit. In other words, it affords more latitude in designing a developer supply container, making it possible to realize a developer supply container which is superior in developer discharge, and yet, does not make developer coarse.

According to Countermeasure 4, however, the opening of the developer outlet of a developer supply container extends virtually from one end of the container proper to the other in terms of the direction parallel to the rotational axis of the stirring wing, and the stirring member is not effective in conveying developer in the direction parallel to the rotational axis of the stirring member. Therefore, this countermeasure is applicable only to a developer supply container structured so that the developer therein is conveyed by its stirring member only in the direction perpendicular to the rotational axis of the stirring member. In other words, this countermeasure is not suitable for a developer supply container, the opening of the developer outlet of which does not extend across the entirety of the container in terms of the direction parallel to the axial line of the stirring member.

Further, FIG. 14 in Patent Document 5, or one of the referential documents, shows that a stirring member, which is structured to enable it to convey developer in the direction parallel to its rotational axis. More specifically, the flexible wings (members) of this stirring member perpendicularly project from the center shaft of the stirring member, and are provided with such slits that create two groups of stirring wing portions different in rotational radius (flexibility), enabling thereby the stirring member to convey developer in the direction parallel to the rotational axis of the stirring member. This structural arrangement creates the problem that certain areas of the internal surface of the container proper of a developer supply container cannot be scraped by the stirring wing, and therefore, developer cannot be satisfactorily conveyed.

SUMMARY OF THE INVENTION

The primary object of the present invention is to provide a developer supply container, which is not cylindrical, simple in structure, and yet, is capable of efficiently stirring and conveying developer while minimizing the damages to the developer.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Next, the developer supply container in the first embodiment of the present invention will be described, along with the electrophotographic image forming apparatus in which the developer supply container is mountable.

Embodiment 1

{General Structure of Image Forming Apparatus}

First, referring to FIG. 1, the structure of a typical electrophotographic copying apparatus in which the developer supply container in the first embodiment of the present invention is mountable will be described.

Figure 1:
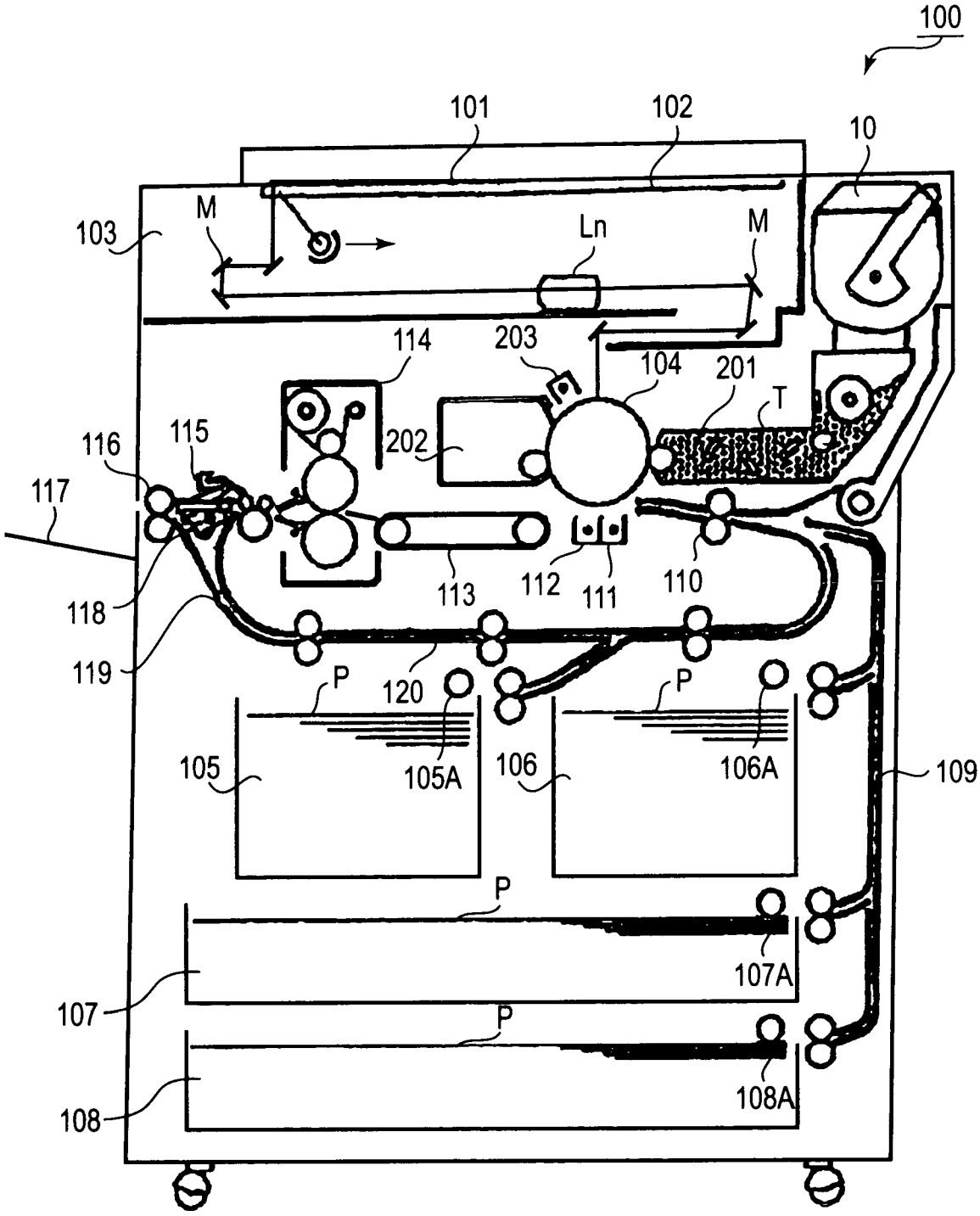
FIG. 1 is a vertical schematic section of the main assembly of an electrophotographic image forming apparatus, in which a developer supply container is mounted.

In FIG. 1, designated by a referential number 100 is the main assembly of an electrophotographic copying machine (which hereinafter may be referred to simply as "apparatus main assembly"). Designated by a referential number 101 is an original placed on an original placement platen 102 so that the optical image of the original 101, which carries the data necessary for forming an image of the original 101, is formed on the peripheral surface of the photosensitive drum 104 by the multiple mirrors M and lens Ln of the optical portion 103. Designated by referential numbers 105–108 are cassettes for sheets P of recording medium. Among these cassettes 105–108, the cassette which contains the sheets P matching in size the sheet size data inputted by a user through the control panel (unshown) of the apparatus main assembly, or the sheet size of the original, is selected.

Then, the sheets P in the selected cassette are fed into the apparatus main assembly, by the conveying-separating apparatus 105 (105A–108B), while being separated from the subsequent sheets P. Then, the each sheet P is conveyed through the sheet conveyance passage, to a pair of the registration rollers 110, which temporarily hold the sheet P and releases it in synchronism with the rotation of the photosensitive drum 104 and scanning of the original by the optical portion 103, in order to allow the sheet P to be conveyed further. Incidentally, referential numbers 111 and 112 designate the transfer charging device and separation charging device, respectively.

After the formation of a visible image (image formed of developer) on the peripheral surface of the photosensitive drum 104, the sheet P is conveyed by the sheet conveying portion 113 to the fixing portion 114, in which the developer on the sheet P is fixed to the sheet P by heat and pressure. Thereafter, when the image forming apparatus is in the one-sided print mode, the sheet P is conveyed through the discharging-reversing portion 115, and discharged by a pair of the discharge rollers 116 into the delivery tray 117. When the image forming apparatus is in the two-sided print mode, the flapper 118 of the discharging-reversing portion 115 is controlled so that the sheet P is conveyed through the re-feeding conveyance passages 119 and 120, to the pair of the registration rollers 110, and then, it is discharged into the delivery tray 117 after being conveyed through the same route as the route through which it was conveyed first time through the apparatus main assembly.

When the image forming apparatus is in the multilayer print mode, the sheet P is conveyed through the discharge-reversing portion 115, and is partially discharged from the apparatus main assembly by the pair of discharge rollers 116. More specifically, while the trailing edge of the sheet P is between the flapper 118 and the pair of the discharge rollers 116, the flapper 118 is switched in position and the discharge rollers 116 are reversed in rotation, so that the sheet P is fed back into the apparatus main assembly. Then, the sheet P is conveyed to the pair of registration rollers 110 through the re-feeding portions 119 and 120. Then, it is discharged into the delivery tray 117 after being conveyed though the same route as the route through which it was conveyed first time through the apparatus main assembly.

In the main assembly 100 structured as described above, the developing device 201, cleaning portion 220, and primary charging device 203 are disposed around the peripheral surface of the photosensitive drum 104. The developing device 201 is for adhering developer to the peripheral surface of the photosensitive drum 104 in order to visualize an electrostatic latent image formed on the peripheral surface of the photosensitive drum 104 by the optical portion 103 in accordance with the image formation data extracted from the original 101. The developer supply container 10 is for supplying the developing device 201 with developer T, and is removably mounted in the apparatus main assembly 100.

{Developer Supply Container}

Next, referring to FIGS. 2–4, the developer supply container in this embodiment will be described.

Figure 2:
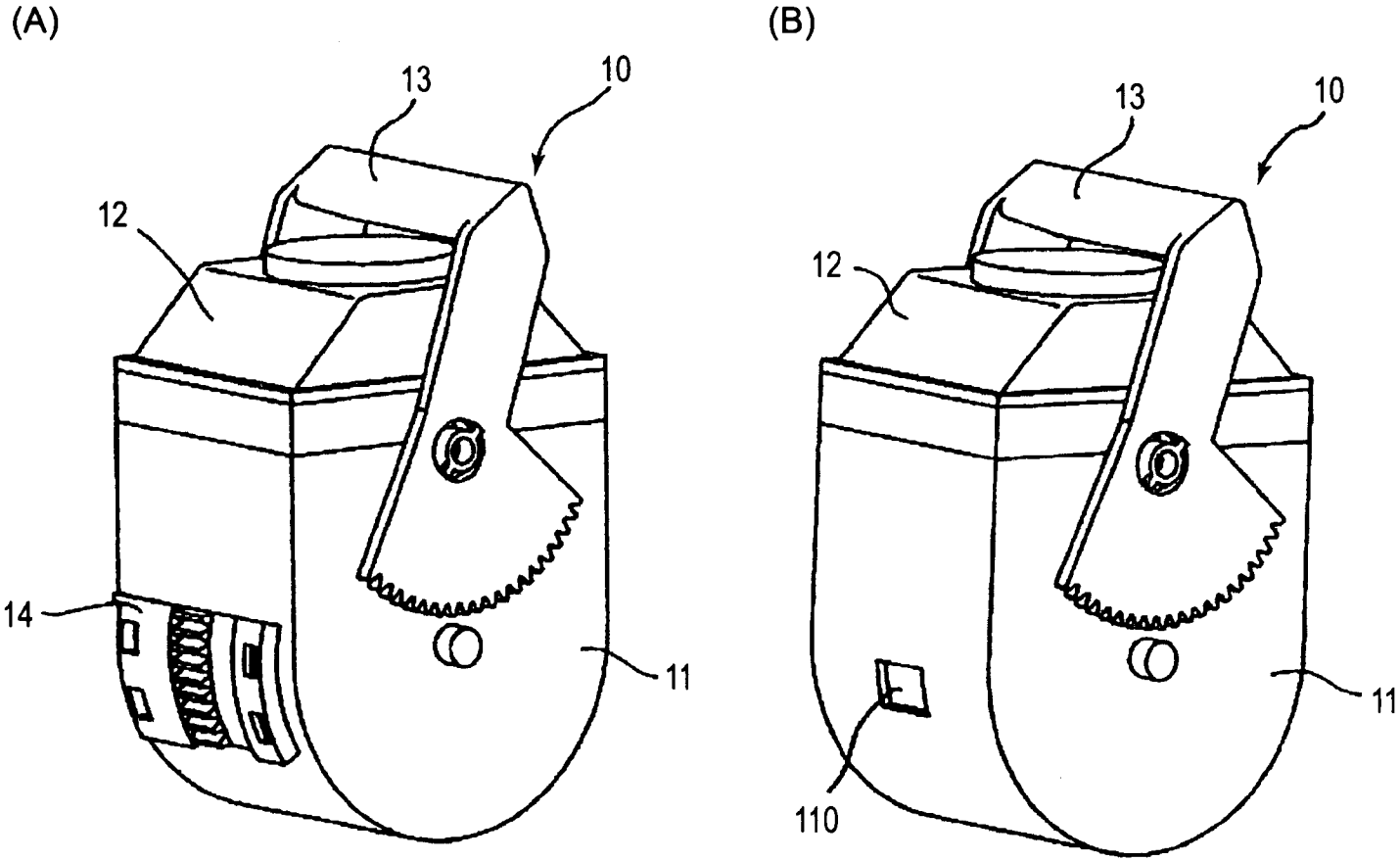
FIG. 2 is a perspective view of the developer supply container in the first embodiment of the present invention, FIGS. 2(A) and 2(B) showing the developer supply container with a shutter, an the developer supply container without a shutter, respectively.

FIG. 2 is a perspective view of the developer supply container 10 in this embodiment of the present invention. FIGS. 2(A) and 2(B) show the developer supply container 10 prior to, and after, the removal of the shutter 14, respectively. FIGS. 3(A) and 3(B) are sectional views of the developer supply container 10 shown in FIG. 2, respectively, parallel with and perpendicular to, to the axial line of the stirring wing support shaft 17 of the stirring member. FIG. 4 shows the stirring wing 16 in this embodiment.

The developer supply container 10 in FIG. 2 is of the cartridge type. In other words, it is left in the apparatus main assembly 100 to gradually supply the developing device 201, as an object to be supplied with developer, with developer T, until the developer supply container 10 runs out of the developer T. Further, it is virtually non-rotatably placed in the apparatus main assembly 100.

The developer supply container 10 in this embodiment comprises the container proper 11 as a developer storage portion for storing the developer T, and a lid 12 attached to the container proper 11 with the use of one of the known means such as ultrasonic welding. It also comprises a knob 13. It is provided with the developer discharge opening 11*a*, through which the developer T in the container proper 11 is discharged. Next, referring to FIG. 3, the developer supply container 10 is provided with a developer stirring member 15, which is placed in the container proper 11. The developer supply container 10 is for supplying the developing device 201 with the developer T as described above, and is structured so that an operator can inserted into, or removed from, the apparatus main assembly 100, by manipulating the aforementioned knob 13.

Incidentally, the method for assembling the developer supply container 10 and the method for inserting it into the apparatus main assembly 100 or removing it therefrom has little relation to the gist of the present invention. In other words, they may be different from those which will be described below.

(Configuration of Developer Supply Container)

Next, the configuration of the developer supply container 10 will be described in detail. Referring to FIG. 2, the bottom portion of the container proper 11 of the developer supply container 10 is semicylindrical, and the top portion thereof is in the form of a hollow rectangular parallelepiped, the dimension of which in terms of the direction perpendicular to the center line of the curvature of the semicylindrical bottom portion is roughly equal to the diameter of the semicylindrical bottom portion. The developer supply container 10 in this embodiment is roughly 90 mm in width (diameter of semicylindrical portion: W in FIG. 3(B)), and roughly 135 mm in height (H in FIG. 3(B)). In other words, the developer supply container 10 is structured so that the ratio between its width and height becomes roughly 1:1.5.

Figure 3:
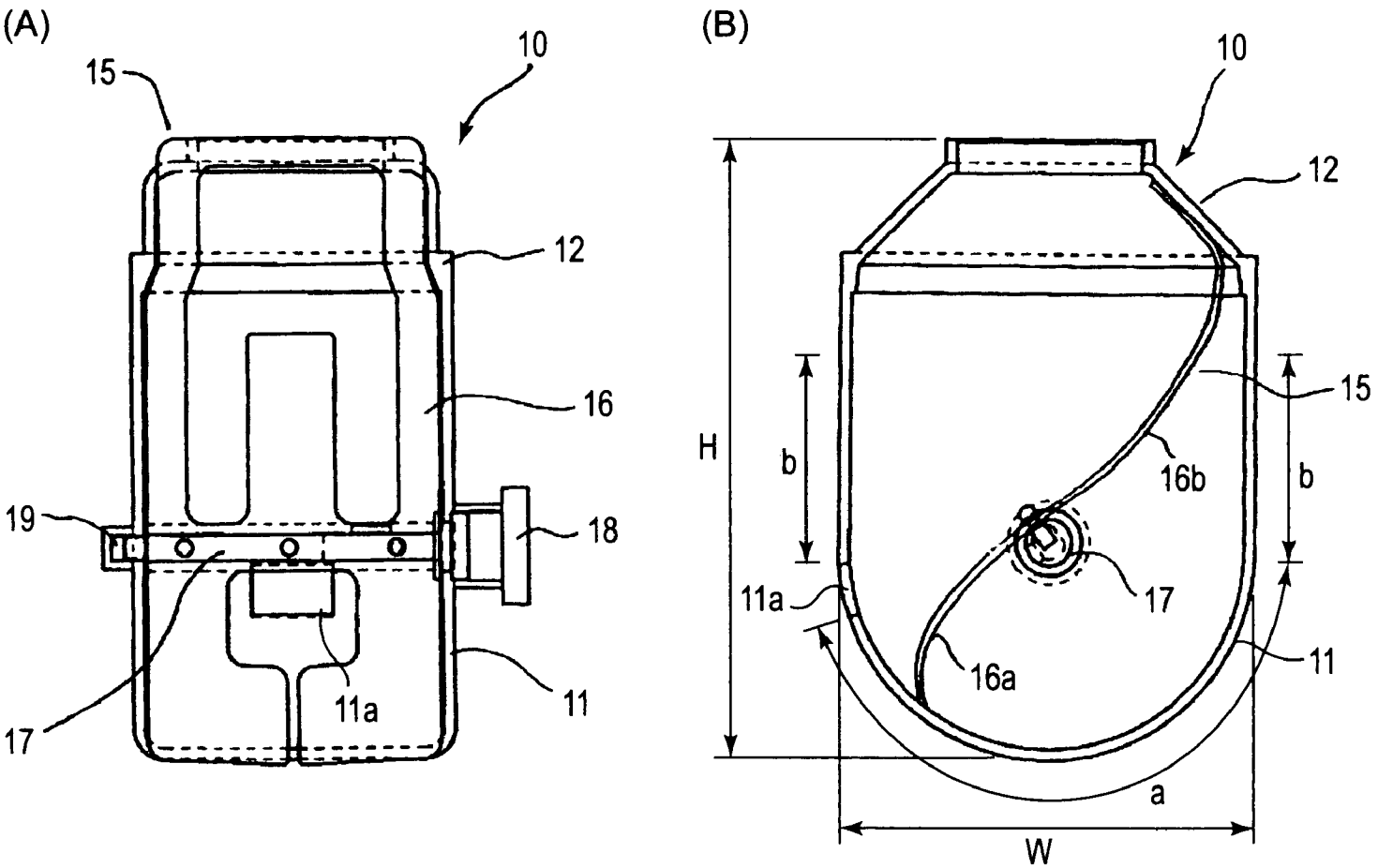
FIGS. 3(A) and 3(B) are sectional views of the developer supply container in the first embodiment, parallel and perpendicular, respectively, to the axial line of the stirring member thereof.

Referring to FIG. 3, the developer supply container 10 is provided with a stirring member 15, which is rotatably supported in the container proper 11, in order to convey the developer T in the container proper 11 while stirring it. The the rotational axis of the stirring member 15 roughly coincides with the center line of the curvature of the semicylindrical portion.

The wall of the bottom portion, or the cylindrical portion, of the developer supply container 10 is provided with the developer discharge opening 11*a*, through which the developer T is discharged from the developer supply container 10 in order to supply the apparatus main assembly 100 with the developer T. In terms of the direction parallel to the rotational axis of the stirring member 15, the opening 11*a* is located roughly at the center of the developer supply container 10. In terms of the angle relative to the vertical line drawn through the rotational axis of the stirring member 15, it is located roughly 60° away from the vertical line. The developer discharge opening 11*a* is in the form of a rectangular parallelepiped. It is roughly 20 mm in length in terms of the direction parallel to the rotational axis of the stirring member 15, and roughly 10 mm in width in terms of the rotational direction of the stirring member 15.

The dimension W of the developer supply container 10 is not limited by the gist of the present invention. However, when the stirring wing 16 formed of flexible substance alone is used, the dimension W is desired to be no more than 300 mm, because, if the distance from the rotational axis of the stirring wing 16 to the internal surface of the container proper 11 is greater than a certain value, the rigidity of the stirring wing 16 formed of flexible substance alone is insufficient for the stirring wing 16 to efficiently conveying the developer T while stirring it. However, the stirring member 15 comprising the stirring wing support shaft 17, and the stirring wing 16 formed of a flexible substance alone, is provided with ribs or the like, in order to provide the stirring wings 16 with a certain amount of rigidity, the dimension W does not need to be limited to a value no more than 300 mm.

As for the vertical dimension H of the developer supply container 10, it is limited by the widthwise dimension W of the developer supply container 10, because of the structure of the stirring wing 16, which will be descried later. Thus, in this embodiment, the range of the vertical dimension H is determined in proportion to the widthwise dimension W. More specifically, from the standpoint of the stirring-conveying performance, the vertical dimension H of the developer supply container 10 is desired to be no more than roughly 1.0–2.5 times, preferably, no more than 2.0 times, the widthwise dimension W of the developer supply container 10.

The position and size of the developer discharge opening 11*a* is desired to be determined based on the requirements which must be met when designing the main assembly of an image forming apparatus, the properties of the particulate developer T to be stored in the developer supply container 10, and the like factors. However, they have little to do with the gist of the present invention.

(Developer Stirring Member)

Referring to FIG. 3, the developer stirring member 15 comprises the stirring wing support shaft 17 as a rotational shaft, and the stirring wing 16. The stirring wing 16 is formed of a flexible resin sheet, and is attached to the stirring wing supporting stirring wing support shaft 17. The developer stirring member 15 is disposed in the developer supply container 10. The stirring wing support shaft 17 is in the form of a rod.

One end of the stirring wing support shaft 17 is provided with a receptacle, into which a coupler 18 (for transmitting driving force from image forming apparatus main assembly 100 to developer stirring member 15) is inserted through the hole in one of the lateral walls of the developer supply container 10, and the other end is fitted in the shaft supporting hole 19, with which the other lateral wall of the developer supply container 10 is provided. As for the method for attaching the stirring wing 16 to the support shaft 17, any of the known methods may be employed; for example, snap fitting, thermal cramping, screws, etc.

The stirring wing 16 is cut out of a sheet of flexible resin. As for the material suitable for the stirring wing 16, any resinous sheet is usable, as long as it has a proper amount of elasticity and a proper amount of resistance to creeping. For example, there are polyacetal sheet, polyurethane sheet, fabric lined with rubber, etc. However, polyester film is preferable. In this embodiment, polyester film is used as the material for the stirring wing 16. The thickness of the polyester film may be adjusted according to the size (in particular, radius of semicylindrical bottom portion) of the developer supply container 10, type of the developer T to be stored in the developer supply container 10, configuration of the stirring wing 16, etc. However, it is desired to be in the range of 50–500 μm, preferably, 150–300 μm. The configuration of the stirring wing 16 will be described later.

If the thickness of the stirring wing 16 is no more than 50 μm, the stirring wing 16 is insufficient in resiliency, being therefore insufficient in developer conveyance performance, and also, is insufficient in the strength of the joint formed between the stirring wing 16 and the stirring wing support shaft 17 as the stirring wing 16 is attached to the stirring wing support shaft 17. Further, if the stirring wing 16 is no more than 50 μm in thickness, it is difficult to handle when assembling the developer supply container 10. Therefore, it should not be no more 50 μm in thickness. On the other hand, if the stirring wing 16 is no less than 500 μm in thickness, it is too resilient, requiring therefore a large amount of torque for the stirring member 15 to be rotated within the developer supply container 10. Further, if the stirring wing 16 is no less than 500 μm in thickness, it is less likely to elastically deform, creating a problem when assembling the developer supply container 10. In this embodiment, 250 μm thick film is employed as the material for the stirring wing 16.

As for the method for processing the flexible resin sheet in order to form the stirring wing 16, the stirring wing 16 is desired to be punched out in a single piece, with the use of a press fitted with a jig provided with a blade for cutting the flexible resin sheet, so that first and second wing portions, holes used for attaching the stirring wing 16 to the support shaft 17, are formed all at once. This method is desired because it makes it possible to precisely and inexpensively manufacture the stirring wing 16.

Next, the stirring wing 16 will be described in detail regarding its configuration, structure, and also, the function its performs in the developer supply container 10.

A single-piece stirring wing 16 formed of flexible resin sheet is shaped so that it extends from the stirring wing support shaft 17 roughly in the opposing two directions. More specifically, the stirring wing 16 comprises first and second wing portions 16*a* and 16*b*. The first wing portion 16*a* is a conveyance portion for conveying the developer T in the direction parallel to the rotational axis of the stirring wing support shaft 17. The second wing portion 16*b* is made greater in the length (from its base, by which it is attached to stirring wing support shaft 17, to its tip) than the first wing portion 16*a*, being enabled to reach the portions of the internal surface of the container proper 11 of the developer supply container 10, which the first wing portion 16*a* is unable to scrape, in order to scrape away the developer T stuck in the dead space (space adjacent to ceiling of container proper), and the developer T adhering to the internal surface of the container proper 11.

(First Wing Portion)

Next, the first wing portion 16*a* (short wing portion) as a developer conveying portion will be described.

<Configuration of First Wing Portion>

Figure 4:
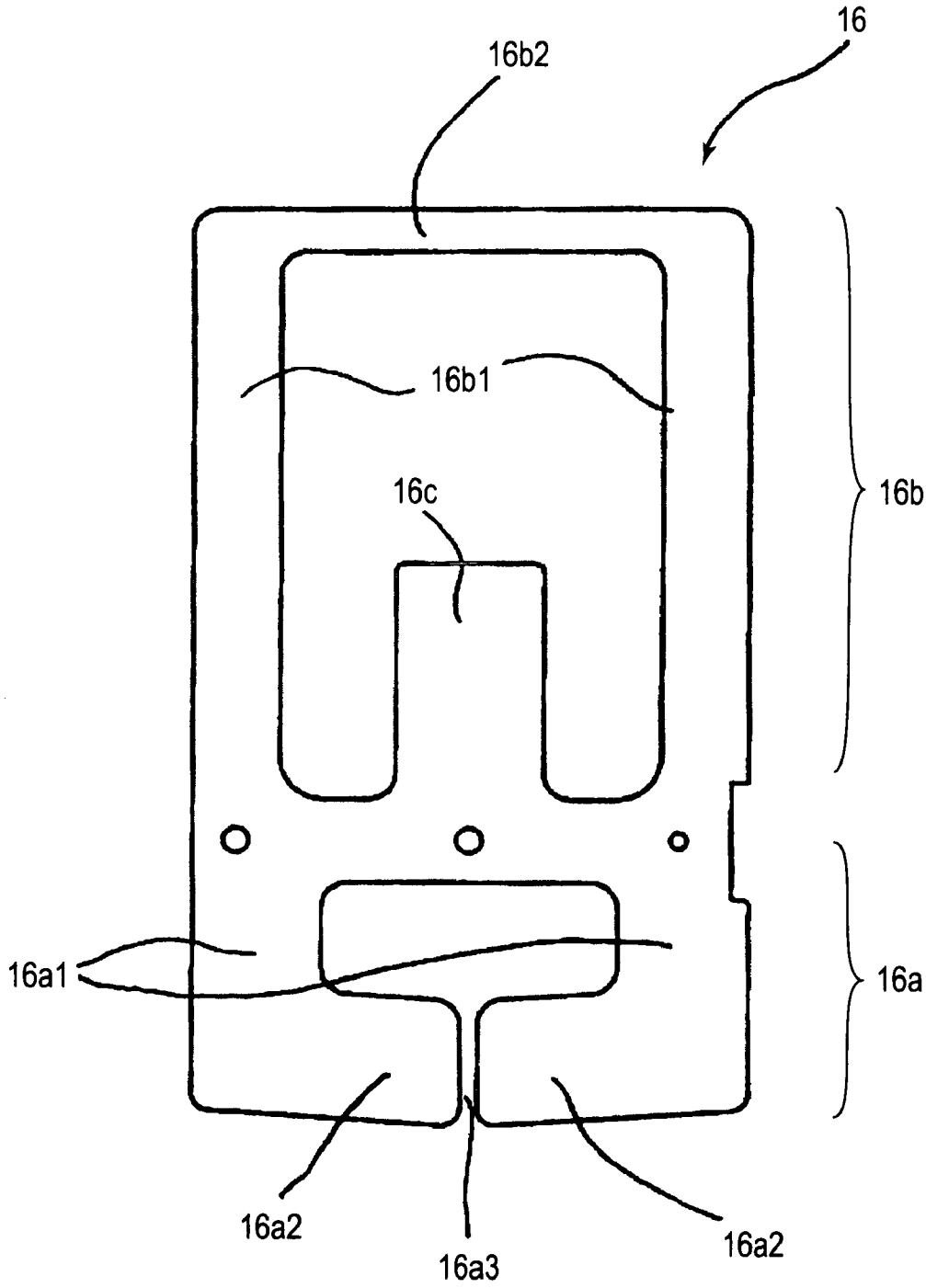
FIG. 4 is a plan view of the stirring member in the first embodiment, as seen from the direction of the front panel of the developer supply container.

Referring to FIG. 4, the first wing portion 16*a* primarily comprises the main portion 16*a*1 and a pair of scraping portions 16*a*2.

In this embodiment, the developer discharge opening 11*a* of the container proper 11 is made smaller than the developer storage space of the cylindrical container proper 11, and is located roughly in the middle of the cylindrical container proper 11. Therefore, the left scraping portion 16*a*2 shown in FIG. 4 is extended rightward, or toward the developer discharge opening 11*a*, whereas the right scraping portion 16*a*2 is extended leftward, or toward the developer discharge opening 11*a*. In other words, the first wing portion has two roughly L-shaped sections.

The distance from the peripheral edge of the scraping portion 16*a*2 to the rotational support shaft 17 is set to be large enough for the peripheral edge of the scraping portion 16*a*2 to gently scrape the internal surface of the semicylindrical bottom portion of the container proper 11.

In this embodiment, for the purpose of minimize the unextractable amount of toner, by conveying the developer T in the container proper 11 toward the developer discharge opening 11*a* while scraping down the toner adhering to the internal surface of the semicylindrical bottom portion of the container proper 11, and also, minimizing the amount by which the toner particles are agglomerated into coarse particles by the scraping portion 16*a*2 which causes the toner particles to rub against the internal surface of the container proper 11, the distance from the rotational support shaft 17 and the peripheral edge of the scraping portion 16*a*2 is made only slightly longer than the rotational support shaft 17 and the internal surface of the semicylindrical bottom portion of the container proper 11.

Referring to FIG. 4, in this embodiment, for the reasons, which will be described later, the scraping portion 16*a*2 of the first wing portion 16*a* is shaped to make the peripheral edge, that is, the scraping edge, of the scraping portion 16*a*2 angled relative to the rotational axis of the stirring member 15, so that the closer to the developer discharge opening 11*a*, the greater the contact area between the scraping portion 16*a*2 and the internal surface of the semicylindrical bottom portion of the container proper 11.

Also in this embodiment, the stirring wing 16 is also provided with an auxiliary wing portion 16*c*, in addition to the first wing portions 16*a*. The auxiliary wing portion 16*c* is provided to convey the developer T in the area in which the first wing portion 16*a* fails to convey the developer T due to the provision of a slit 16*a*3 between the two first wing portions 16*a*2. Thus, the auxiliary wing portion 16*c* is positioned so that its center line virtually coincides with that of the slit 16*a*3. Further, it is configured so that the distance from its peripheral edge, or scraping edge, to the rotational support shaft 17 becomes just right for the peripheral edge to gently scrape the internal surface of the semicylindrical bottom portion of the container proper 11, for the same reason as those for the scraping portion 16*a*2.

Further, the first wing portion 16*a* is structured so that it scrapes the entirety of the internal surface of the container proper 11 of the developer supply container 10, within the range from one end of the rotational axis of the rotational support shaft 17 to the other. Thus, it is assured that the entirety of the developer T, which is within the range from one end of the rotational axis of the rotational support shaft 17 to the other, is conveyed while being stirred, making it possible to deliver the developer T in the developer supply container 10, to the image forming apparatus 100, virtually in its entirety.

<Length of First Wing Portion>

Next, the position of the rotational axis of the stirring member 15, and the dimension of the first wing portion 16*a* in terms of the direction perpendicular to the rotational axis of the stirring member 15, will be described.

As described above, the stirring member 15 is required to supply the image forming apparatus main assembly 100 with the developer T from the developer supply container 10, in response to the request from the main assembly, by conveying the developer T, in the developer supply container 10, and discharging the developer T from the developer supply container 10. Thus, it is required to have a certain amount of developer conveying performance. Obviously, the greater the contact area between the peripheral edge portion of the first wing portion 16*a* and the internal surface of the container proper 11 (amount of theoretical entry of peripheral edge portion of first wing portion 16*a* into wall of container proper), the higher the scraping pressure (contact pressure), and therefore, the higher the developer conveyance performance.

However, the higher the scraping pressure, the greater the extent of the damage the developer (toner) T in the developer supply container 10 sustains due to the scraping pressure from the first wing portion 16*a*, and therefore, the possibility of the formation of coarse toner. Thus, it is essential to set the aforementioned dimension of the first wing portion 16*a* (amount of theoretical entry to lateral wall of container proper) while balancing the developer conveying performance of the first wing portion 16*a* relative to the possibility of the damage to the developer (toner) T.

Therefore, in the case of a developer supply container shaped like the developer supply container 10 in this embodiment, where the developer conveying performance of the stirring member 15 is to be highest in its rotational range is from a certain point on the upstream side of the lateral wall of the container proper 11 to the developer discharge opening 11*a* of the developer supply container 10 (arcuate range a in FIG. 3(B)). Therefore, where the rotational axis of the stirring wing 16 is to be positioned, and the length of the first wing portion 16*a*, are desired to be determined so that the scraping pressure becomes most stable and strong in this range.

Figure 5:
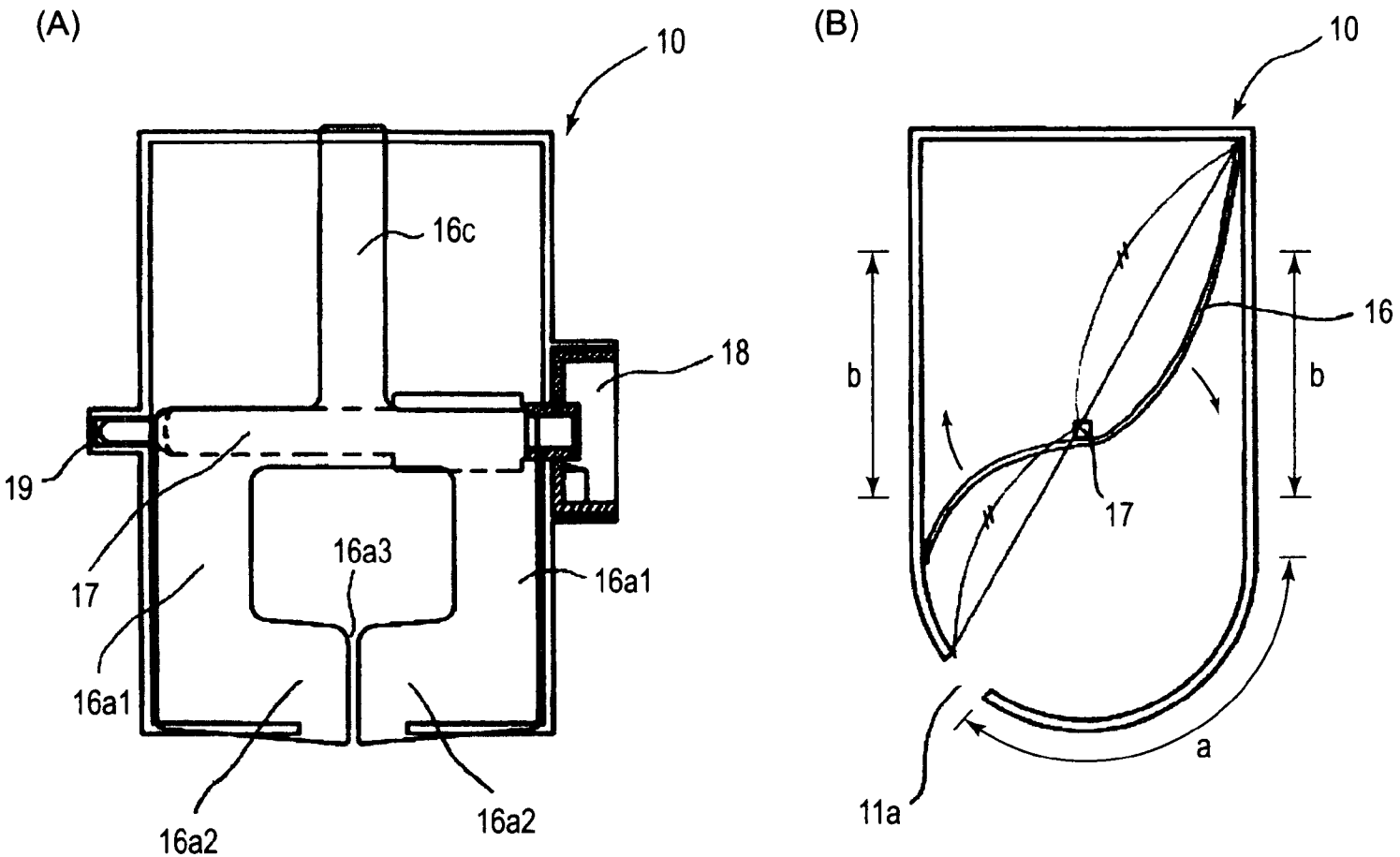
FIG. 5 is a sectional view of a first developer supply container comparable to the one in the first embodiment of the present invention.

In comparison, if the stirring member 15 is positioned so that the rotational axis of the stirring wing 16*a* coincides with the mid point of the largest cross-sectional distance as shown in FIG. 5, the scraping pressure becomes greater in the range (range b in FIG. 5(B)) where the stirring wing 16 is not required to convey the developer T, than in the range (range a in FIG. 5(B)) where the developer conveying performance of the stirring wing 16 needs to be highest. Thus, if the length of the first wing portion 16*a* is set so that the developer conveying performance of the first wing portion 16*a* becomes higher in the range a in FIG. 3(B), the contact pressure between the first wing portion 16*a* and internal surface of the container proper 11 becomes too strong in the range b in FIG. 3(B), being therefore likely to produce coarse developer (toner) T, which is undesirable.

Figure 6:
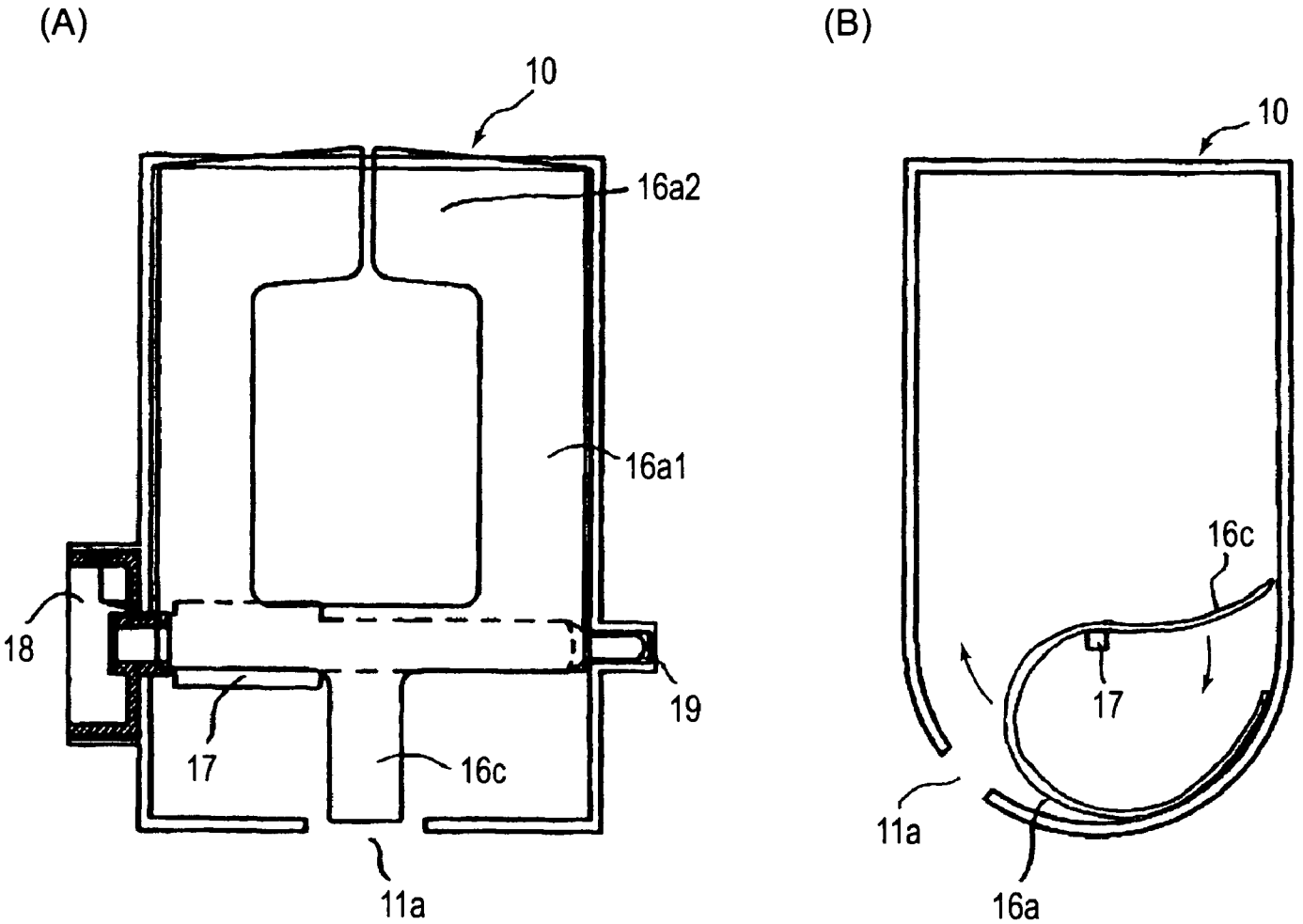
FIG. 6 is a sectional view of a second developer supply container comparable to the one in the second embodiment of the present invention.

On the other hand, if the first wing portion 16*a* is lengthened, instead of changing the position of the rotational axis of the stirring member 15, so that it reaches any point of the internal surface of the container proper 11 as shown in FIG. 6(A), the first wing portion 16*a* is excessively deformed, as shown in FIG. 6(B), causing its scraping portion 16*a*2 to lose developer conveying ability, as the stirring member 15 is rotated. Therefore, the wing portion 16*a* cannot satisfactorily convey the developer T. Thus, this setup also is not desirable.

Here, the amount of theoretical entry of the stirring wing 16 (scraping area size) means the difference between the distance from the rotational axis of the stirring wing 16 to the peripheral edge of the first wing portion 16*a*, or the peripheral edge of the second wing portion 16*b*, in terms of the direction of the rotational radius of the stirring wing 16, when the stirring wing 16 is flat, and the distance from the rotational axis of the stirring wing 16 to the internal surface of the container proper 11.

In this embodiment, the stirring wing 16 is positioned so that the rotational axis of the stirring wing 16 roughly coincides with the center of the curvature of the semicylindrical bottom portion of the developer supply container 10, and the length of the first wing portion 16*a* is set to a value in the range of 47–48 mm, so that it will be 2–3 mm greater than the distance from the rotational axis of the stirring wing 16 to the internal surface of the semicylindrical bottom portion. The length of the first wing portion 16*a* is optional; it may be set according to the configuration of the first wing portion 16*a*, and the properties of the developer to be stored in the developer supply container 10. However, it is desired to be set so that it will be 0.5–10 mm longer than the distance from the rotational axis of the stirring wing 16 to the internal surface of the semicylindrical bottom portion.

The first wing portion 16*a* structured as described above is resilient enough to display a high level of developer conveyance performance, even though it is provided with the slit 16*a*3. Further, it is structured so that the developer discharge opening 11*a* side of the scraping portion 16*a*2 is more flexible than the portion of the scraping portion 16*a*2 adjacent to the main portion 16*a*1. Therefore, when the stirring wing 16 scrapes the internal surface of the container proper 11, the developer discharge opening 11*a* side of the scraping portion 16*a*2 always trails the portion of the scraping portion 16*a*2 adjacent to the main portion 16*a*1. Therefore, as the developer stirring member 15 is rotated, the developer discharge opening 11*a* side of the scraping portion 16*a*2 becomes tilted in the direction to very effectively guide the developer T toward the developer discharge opening 11*a*.

Further, the first wing portion 16*a* is structured so that the closer to the center of the container proper 11 in terms of the direction parallel to the axial direction of the support shaft 17, the greater the amount by which the scraping portion 16*a*2 scrapes the internal surface of the semicylindrical bottom portion of the container proper 11, per unit width of the scraping portion 16*a*2. Therefore, the closer to the center of the container proper 11 in terms of the direction parallel to the axial direction of the support shaft 17, the greater the flexing of the scraping portion 16*a*2, and therefore, the more effective the scraping portion 16*a*2 in conveying the developer T at an angle relative to the direction perpendicular to the axial line of the support shaft 17. In other words, because the first wing portion 16*a* is structured as described above, the developer T is conveyed in the direction parallel to the rotational axis of the support shaft 17 as the stirring member 15 is rotated. In addition, providing the first wing portion 16*a* with the slit 16*a*3 decreases the amount of torque necessary to rotate the stirring member 15.

Further, the stirring member 15 is provided with the auxiliary wing portion 16*c*, which extends from the support shaft 17 in the direction opposite to the direction in which the first wing portion 16*a* extends from the support shaft 17, and the center of which aligns with the center of the slit 16*a*3 of the first wing portion 16*a*. Therefore, the developer T on the area of the internal surface of the container proper 11, which is not scraped by the scraping portions 16*a*2, can be discharged through the developer discharge opening 11*a*, minimizing the unextractable amount of the developer T.

However, if the developer T becomes compacted in the adjacencies of the developer discharge opening 11*a* due to the vibrations or the like which occur while the developer supply container 10 is delivered to a user, it is possible that a stirring wing such as the stirring wing 16 in this embodiment formed of polyester film alone will not be able to loosen the compacted developer T, being therefore capable of discharging the developer T only in an unsatisfactory manner.

Thus, the developer supply container 10 should be packaged upside down as shown in FIG. 7(A) so that the developer discharge opening 11*a* faces upward. With the developer supply container 10 packaged as described above, should the developer T becomes compacted due to the vibrations during shipment, the compacted developer T loosens as a user orients the developer supply container 10 in the fashion in which the developer supply container 10 is to be placed when it is used. As a result, the developer T can be easily stirred and discharged even by such a stirring wing as the stirring wing 16 in this embodiment formed of polyester film alone, because of the effects of the second wing portion 16, which will be described later.

As will be evident from the above description of the first wing portion 16*a*, when a developer supply container is virtually cylindrical, or is shaped so that it has virtually no dead space, that is, the space outside the reach of the first wing portion 16*a*, the developer T can be very satisfactorily discharged from the developer supply container by providing the developer supply container with the first wing portion 16*a* capable of conveying the developer in the direction parallel to the rotational axis of the support shaft 17.

However, in the case of a developer supply container such as the developer supply container 10 in this embodiment, which is not perfectly cylindrical, if the develop supply container is designed so that the rotational axis of the stirring member 15 is positioned as described above, and the length of the first wing portion 16*a* is set as described above, certain areas of the internal surface of the container proper 11 are left unscraped.

Therefore, it is necessary to provide the stirring member 15 with a second wing portion 16*b* for stirring the developer T in the dead space, or the space which cannot be reached by the first wing portion 16*a*.

(Second Wing Portion)

Next, the second wing portion 16*b* (longer portion) of the stirring wing 16 will be described in detail.

<Configuration of Second Wing Portion>

Referring to FIG. 4, the second wing portion 16*b* extends from the support shaft 17 in the opposite direction (in terms of rotational radius direction) from the first wing portion 16*a*. It comprises a pair of arm portions 16*b*1 which scrape the internal surfaces of the supporting shaft supporting lateral walls of the container proper 11, and a connective portion 16*b*2 which connects the end portions of the arm portions 16*b*1.

<Length of Second Wing Portion>

The arm portion 16*b*1 is made long enough to reach even the farthest point of the internal surface of the container proper 11 from the rotational axis of the stirring wing 16, so that the areas of the internal surface of the container proper 11, which cannot be scraped by the first wing portion 16*a*, can be scraped by the connective portion 16*b*2 which connects the end portions of the pair of arm portions 16*b*1.

However, if the arm portion 16*b*1 is made long enough to reach even the farthest point of the internal surface of the container proper 11 from the rotational axis of the stirring wing 16, when the second wing portion 16*b* is scraping the internal surface of the semicylindrical bottom portion of the container proper 11, it is excessively bent, becoming therefore largest in the amount of the pressure it applies to the internal surface and the developer particles thereon, possibly damaging the developer T and/or producing coarse toner particles.

Therefore, the arm portion 16*b*1 of the second wing portion 16*b* is made narrower than the main portion (arm portion) 16*a*1 of the wing portion 16*a* (FIG. 4), in order to make the arm portion 16*b*1 more flexible to reduce the amount of the pressure which the arm portion 16*b*1 applies while it scrapes, so that toner will not be made coarse.

In principle, the arm portion 16*b*1 is required to be long enough to reach all the areas of the internal surface of the container proper 11, which cannot be reached by the first wing portion 16*a*. However, this does not means that the arm portion 16*b*1 may be limitlessly extended. That is, if the arm portion 16*b*1 is extended too much, the size of the area which the second wing portion 16*b* scrapes per unit width of the second wing portion 16*b* as the stirring member 15 is rotated becomes too large; in other words, the second wing portion 16*b* overlaps with the first wing portion 16*a*, possibly adversely affecting the developer conveyance performance of the first wing portion 16*a*.

Thus, in order to prevent the above-described problem, the length of the arm portion 16*b*1 is made long enough to gently scrape the ceiling portion of the internal surface of the container proper 11; more specifically, it is made to be no more than roughly 4.5 times the radius of the semicylindrical bottom portion of the developer supply container 10.

As for the dimension of the arm portion 16*b*1 in terms of the direction parallel to the rotational axis of the support shaft 17, it is desired to be set to make its resiliency weak enough to prevent the production of coarse toner even when it is in the range in which the second wing portion 16*b* is most severely bent, but strong enough to straighten itself and scrape the farthest areas of the internal surface of the container proper 11 from the rotational axis of the support shaft 17.

Further, the second wing portion 16*b* is desired to be made strong enough to prevent it from breaking as it is pulled out of the compacted developer T because of the initial positioning of the stirring wing 16, which will be described later.

As for the width (dimension in terms of direction parallel to rotational axis of support shaft 17) of the arm portion 16*b*1, it is desired to be roughly in the range of 2–15 mm, preferably, in the range of 3–10 mm, although it should be set in accordance with the aforementioned length of the arm portion 16*b*1, the thickness of the polyester film of which the stirring wing 16 is formed, etc. In this embodiment, the arm portion 16*b*1 is structured so that the length of the arm portion 16*b*1 becomes roughly 2.5 times the radius of the semicylindrical bottom portion of the developer supply container 10, and the width of the arm portion 16*b*1 becomes 5 mm.

The direction in which the second wing portion 16*b* extend from the support shaft 17 is opposite to the direction in which the first wing portion 16*a* does.

<Initial Position of Second Wing Portion>

Next, the position in which the second wing portion 16*b* is to be initially placed will be described.

As described above, in order to prevent the developer T from being compacted in the adjacencies of the developer discharge opening 11*a* by the vibrations which occur during shipment, the developer supply container 10 is desired to be packaged upside down, that is, roughly 180° deviated in attitude. However, packaging the developer supply container 10 upside down causes the developer T to become compacted in the ceiling side of the developer supply container 1, or the bottom side of the developer supply container 10 in the upside-down position.

The most of the developer T compacted in the adjacencies of the top portion of the developer supply container 10 usually loosen due to the vibrations which occur when a user takes the developer supply container 10 out of the box which contains the developer supply container 10 and/or when the user places the developer supply container 10 straight in order to mount the developer supply container 10 in the main assembly 100 of an image forming apparatus. Further, it also loosens and falls toward the bottom portion of the container proper 11, where the developer discharge opening 11*a* is located, due to the vibrations, shocks, or the like, when the developer supply container 10 is mounted into the main assembly 100 (FIG. 7(B)).

In other words, the compacted developer T is loosened enough to be discharged from the developer supply container 10 even by a stirring member such as the stirring member 15 in this embodiment, without any problem. Obviously, it is possible that a small amount of the developer T will remain stuck in the adjacencies of the ceiling portion of the developer supply container 10. However, the developer T remaining stuck in the adjacencies of the ceiling portion of the developer supply container 10 can be scraped down by the second wing portion 16*b*, being thereby prevented from causing the developer T to be unsatisfactorily discharged from the developer supply container 10, or adding to the amount of the developer T unextractable from the developer supply container 10. Therefore, the above-described compaction of the developer T does not create a problem as long as the amount of the developer T which remains stuck in the adjacencies of the ceiling portion is relatively small.

However, if the compacted developer T fails to be loosened in spite of the occurrences of the abovementioned shocks or the like, a large amount of the developer T remains attached to the ceiling portion of the developer supply container 10, making it impossible for the second wing portion 16*b* to loosen the compacted developer T by digging into the compacted developer T, because the second wing portion 16*b* is structured to be less resilient. Thus, it is possible that the large amount of the developer T, which is adhering to the ceiling portion, will remain adhered thereto.

As for the means for preventing the above described problem, it is effective to position the second wing portion 16*b* in the space in which the developer T will be blocked, before the developer T becomes compacted therein, for example, before the developer supply container 10 is packaged, or it is filled with the developer T.

With the second wing portion 16*b* positioned as described above, as soon as the stirring member 15 is rotated, the second wing portion 16*b* is moved in a manner to slice through the compacted body of the developer T in which the second wing portion 16*b* has been buried, and therefore, the compacted developer T is pulled down even if nearly all the developer T remains stuck to the ceiling side of the container proper 11 in a manner to bridge between the opposing two lateral walls of the container proper 11; In other words, positioning the second wing portion 16*b* as described above makes it possible to loosen the blocked (compacted) developer T, even if the second wing portion 16*b* is not made stiff enough to enable the second wing portion 16*b* to loosen the blocked (compacted) developer T by digging into the blocked developer T.

In comparison, if the second wing portion 16*b* is not initially positioned as described above, it is left severely bent, as shown in FIG. 6(B), for example, for a long time, before the developer supply container 10 reaches a user, that is, while the developer supply container 10 is shipped to a user, or kept in storage. As a result, the second wing portion 16*b* will becomes permanently deformed due to creep, although the extent of the deformation depends on the length of time the developer supply container 10 is left unattended, or the state of the external ambience. In other words, if the second wing portion 16*b* is not initially positioned as described above, it is possible that the wing portion 16*b* will not fully function.

Therefore, the initial position for the second wing portion 16*b* is to be set as described above in order to provide a highly reliable stirring wing 16, that is, a stirring wing which does not suffer from the above-described problems.

Figure 7:
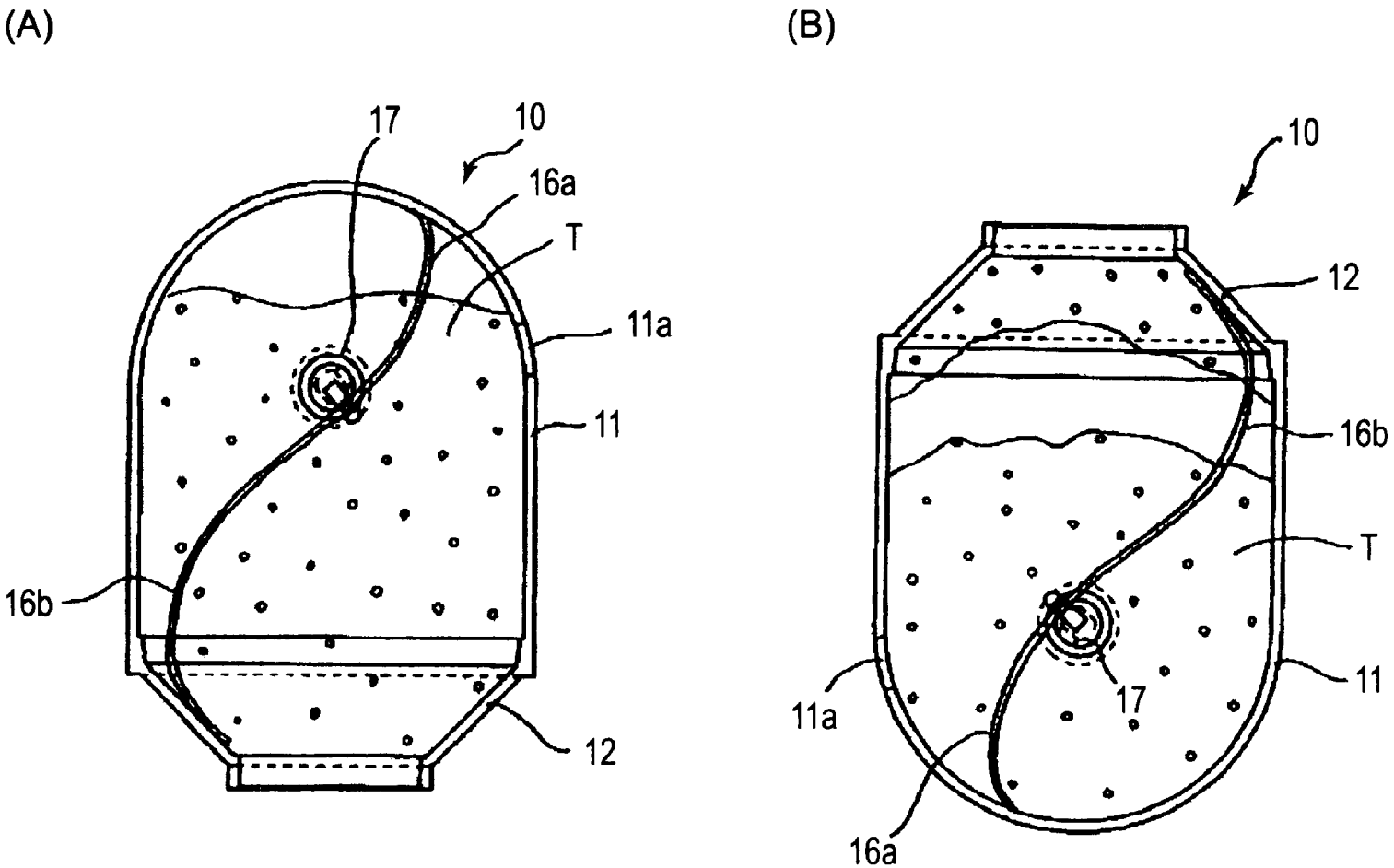
FIG. 7(A) is a sectional view of the developer supply container in the first embodiment, positioned in the attitude in which it is packaged to be shipped, showing the state of the body of the developer therein.
FIG. 7(B) is a sectional view of the developer supply container in the first embodiment, positioned in the attitude in which it is placed in the main assembly of an image forming apparatus, showing the state of the body of developer therein.

As will be evident from the above description of the second wing portion 16*b*, in order to enable the second wing portion 16*b* to be most effective while preventing it from being unaffected by creep, it is desired that the second wing portion 16*b* is initially positioned in the area in which the deformation of the second wing portion 16*b* is not severe, and in which the developer T is most likely to be blocked. In this embodiment, the second wing portion 16*b* is positioned so that its peripheral edge is positioned in the downstream corner of the ceiling portion of the developer supply container 10, in terms of the rotational direction of the stirring member 15, as shown in FIGS. 3 and 7.

(Experiments)

The following are the experiments carried out to test the developer supply container 10 employing the stirring member 15 in this embodiment, in terms of the developer discharging performance.

<Experiment 1>

Figure 8:
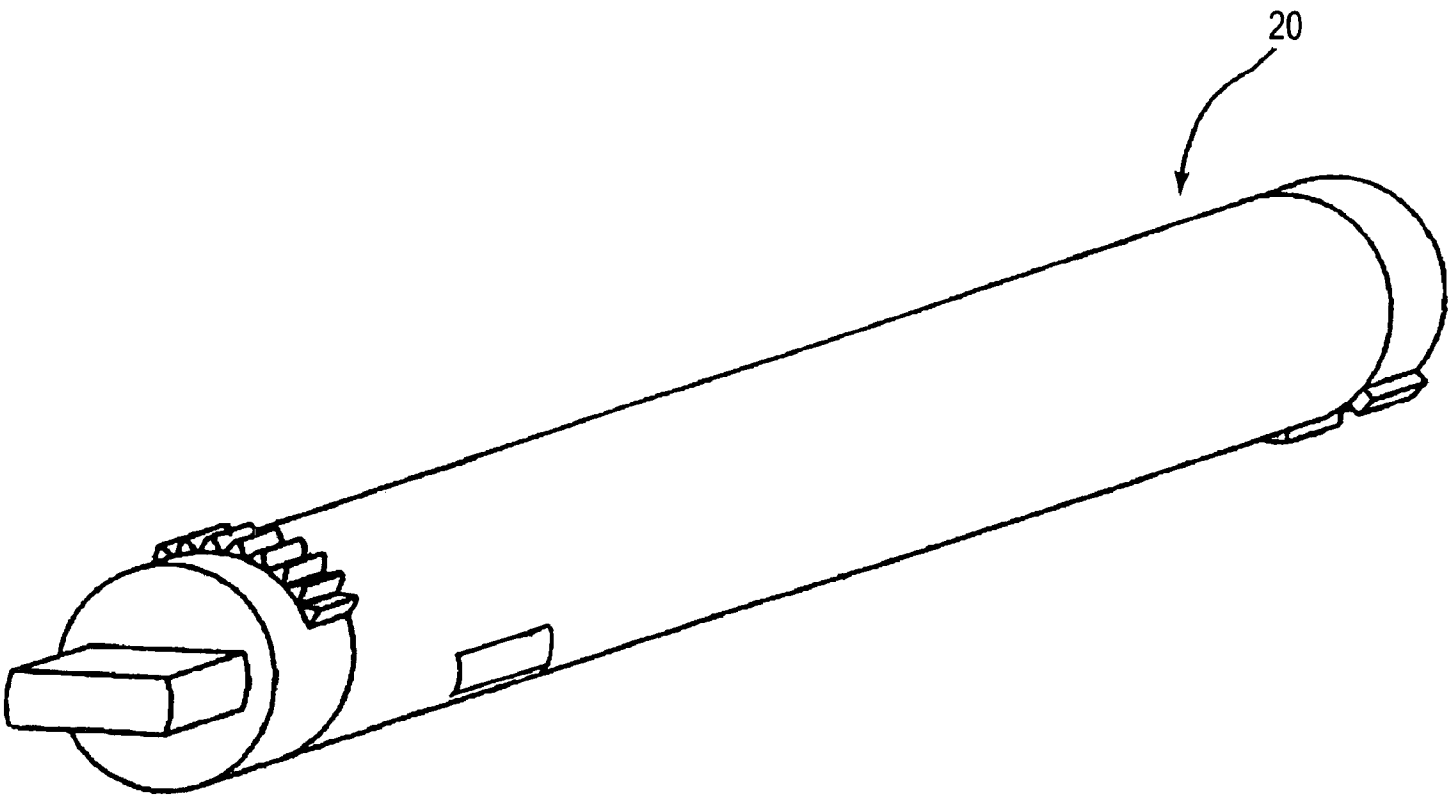
FIG. 8 is a perspective view of a developer supply container in accordance with the prior art, which was used for comparison.

In this experiment, a developer supply container 20 in accordance with the prior art, shown in FIG. 8, which does not require a second wing portion such as the second wing portion 16*b* in this embodiment, is tested under the following conditions.

Amount of developer: roughly 350 g.

Condition: In order to simulate the shipment of the developer supply container 20 (in order to compact the developer in the developer supply container 20), the developer supply container 20 was tapped 1,000 times (2 Hz: dropped from the height of 20 mm) while being kept in the attitude in which it would be placed when packaged.

Stirring wing revolution: 10 rpm.

Condition for ending test: As soon as the amount by which developer is discharged per rotation of the stirring wing falls below 1 g.

Results: The developer was discharged without any abnormality. The amount of the developer T which remained in the developer supply container 20 when the test was ended was in the range of 4–6 g (roughly 1.2–1.7% of initial amount of developer in developer supply container 20). In other words, the developer T was very satisfactorily discharged.

<Experiment 2>

In this experiment, the developer supply container 10 in this embodiment, which was equipped with the stirring member 15 having the first and second wing portions 16*a* and 16*b*, was tested under virtually the same conditions as those in the first experiment, except for the initial amount of the developer in the developer supply container 10 (which was roughly 250 g in this experiment).

The results were virtually the same as those in the first experiment. That is, the developer was discharged without any abnormality. The amount of the developer T which remained in the developer supply container 10 when the test was ended was in the range of 3–5 g (roughly 1.2–2.0% of initial amount of developer in developer supply container 10). In other words, the developer T was very satisfactorily discharged, proving that the developer supply container 10 in this embodiment was virtually equal in developer discharging performance to a roughly cylindrical developer supply container which did not require a second wing portion such as the above-described second wing portion 16*b* in this embodiment.

Further, in order to confirm whether or not the above-described initial positioning of the second wing portion 16*b* is effective when the body of the developer T blocked in the ceiling area does not collapse, the developer supply container 10 was carefully placed upside down to prevent the body of the compacted developer T from collapsing, after the above-described tapping of the developer supply container 10. Then, the developer supply container 10 was tested. As a result, virtually the entirety of the blocked body of developer T collapsed as soon as the second wing portion 16*b* was pulled out of the blocked body of developer T. After the collapse of the blocked body of developer, the developer T was discharged from the developer supply container 10 at the same level of efficiency at which the developer T was discharged when the developer T was not blocked. Therefore, it was proved that the above-described initial positioning of the second wing portion 16*b* was effective.

In another test, the second wing portion 16*b* was positioned as shown in FIG. 6(B), and the developer supply container 10 was left unattended for 10 days in a severe environment (40° in temperature and 90% in humidity). Then, the developer supply container 10 was tested under the same conditions as those described above. As a result, virtually the entirety of the body of developer blocked in the ceiling portion of the developer supply container 10 remained blocked therein; the developer supply container 10 was unsatisfactory in terms of the developer discharging performance.

After the test, the developer supply container 10 was disassembled and examined. As a result, it was discovered that the second wing portion 16*b* had become severely deformed due to creep.

<Experiment 3>

In this embodiment, a developer supply container which was similar in configuration to the developer supply container 10 tested in the second experiment, but lacked the second wing portion 16*b*, was tested in terms of the developer discharging performance (test conditions are the same as those in second experiment).

As for the results, when the body of developer stuck to the ceiling of the developer supply container 10 did not collapse and fall, there was no problem as far as the developer discharging performance of the developer supply container 10 was concerned. However, the amount of the developer T stuck in the dead space where the first wing portion did not reach was substantial; 10–15 g (roughly 4–10% of initial amount of developer in developer supply container 10) of the developer in the developer supply container could not be discharged.

In the test in which the state which the body of developer stuck in the adjacencies of the ceiling of the developer supply container does not collapse and fall was simulated, virtually no developer T was discharged even though the rotation of the stirring member 15 was started; the tested developer supply container was not satisfactory in the developer discharging performance.

<Experiment 4>

The developer supply container tested in this last experiment was the same the developer supply container tested in the second experiment. However, this experiment was different from the second experiment, in terms of the attitude in which the developer supply container was packaged (test conditions other than simulated attitude of developer supply container were the same as those in second experiment). In other words, while the developer supply container was tapped, the developer supply container was kept in the attitude in which the developer discharge opening faced downward (which hereinafter may be referred to as "normal attitude").

In this experiment, the body of developer T compacted in the adjacencies of the developer discharge opening 11*a* sometimes did not easily loosen, making it impossible for the developer supply container to discharge the developer T, or requiring several minutes to several tens of minutes to supply the developer supply container with the developer T by the amount instructed by the image forming apparatus main assembly.

In addition, in some of the developer supply containers, the stirring wing was plastically deformed as it was moved through the compacted developer T. The plastically deformed stirring wing was not able to satisfactorily convey and discharge the developer T, although it was able to loosen the compacted developer T. Therefore, in the case of some developer supply containers, the amount of the developer T which could not be discharged was as much as 20–40 g (roughly 8–16% of initial amount of developer T in developer supply container).

As described above, in this embodiment, the different functions required of the stirring member 15 are separately assigned to the first wing portion 16*a* and second swing portion 16*b*. More specifically, the function of conveying developer while stirring it is assigned to the first wing portion 16*a*, and the function of scraping down the developer T in the dead space, that is, the space which the first wing portion 16*a* does not reach, or the developer T adhering to the internal wall of the container proper 11, is assigned to the second wing portion 16*b*. Therefore, it is possible to provide a developer supply container, which is not cylindrical, simple in structure, inexpensive, and capable of highly efficiently discharging developer without producing coarse toner.

According to this embodiment, the initial position of the second wing portion 16*b*, and the attitude in which the developer supply container is packaged for shipment, are set as described above, preventing thereby the second wing portion 16*b* from becoming deformed due to creep. Therefore, the possibility that the second wing portion 16*b* is adversely affected in its function is eliminated. Therefore, even if the developer T becomes compacted and stuck in certain areas of a developer supply container, it is easily loosened. Therefore, it is possible to provide a highly reliable developer supply container.

Also, this embodiment affords more latitude in designing the developer supply container 10, making it possible to more efficiently use the internal space of the image forming apparatus main assembly 100. Therefore, this embodiment greatly contributes to the effort for reducing the size of the main assembly of an image forming apparatus.

Embodiment 2

Next, referring to FIG. 9, the second embodiment of the present invention will be described.

Figure 9:
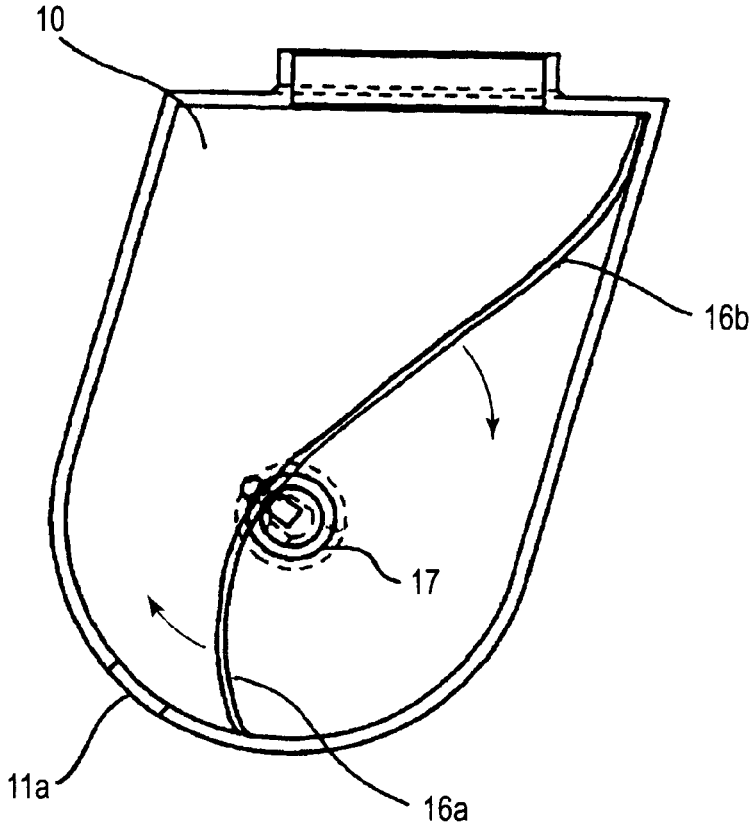
FIG. 9 is a sectional view of the developer supply container in the second embodiment of the present invention.

FIG. 9 is a sectional view of the developer supply container 10 in the second embodiment of the present invention, at a plane perpendicular to the stirring wing support shaft 17.

The developer supply container 10 in this embodiment is an example of a developer supply container in accordance with the present invention, characterized in that due to the restrictions resulting from the design of the main assembly 100 of the image forming apparatus, the opposing two lateral walls of the container proper 11 are angled relative to the top wall of the container proper 11, as shown in FIG. 9, and also, that the container proper 11 is not cylindrical.

This developer supply container 10 was subjected to the experiments similar (except for the amount (roughly 200 g) of developer T with which developer supply container was filled) to those to which the developer supply container 10 in the first embodiment was subjected. The experiments showed that the developer supply container in this embodiment was equal in developer discharging performance to the developer supply container in the first embodiment. The amount of the developer T which could not be discharged from the developer supply container in this embodiment was in the range of 3.2–5.4 g, which was roughly the same as the amount of the developer T which could not be discharged from the developer supply container in the first embodiment. The developer supply container in this embodiment was also similar to the developer supply container in the first embodiment, in terms of the effects of the initial positioning of the stirring wing.

As will be evident from the foregoing description of the developer supply container in this embodiment, the employment of the above-described stirring wing 16 makes it possible to provide a developer supply container, which is simple in stirring wing structure, inexpensive, and superior in developer discharging performance, and yet, does not produce coarse particles (toner particles).

Further, the deformation of the second wing portion 16*b* attributable to creep is prevented by setting the initial position of the second wing portion 16*b* as described above. Therefore, the possibility that the second wing portion 16*b* is adversely affected in its function is eliminated. Therefore, even if the developer T becomes compacted and stuck in certain areas of a developer supply container, it is easily loosened. Therefore, it is possible to provide a highly reliable developer supply container.

Also, this embodiment affords more latitude in designing the developer supply container 10, making it possible to more efficiently use the internal space of the image forming apparatus main assembly 100. Therefore, this embodiment greatly contributes to the effort for reducing the size of the main assembly of an image forming apparatus.

Embodiment 3

Next, referring to FIGS. 10 and 11, the third embodiment of the present invention will be described.

Figure 10:
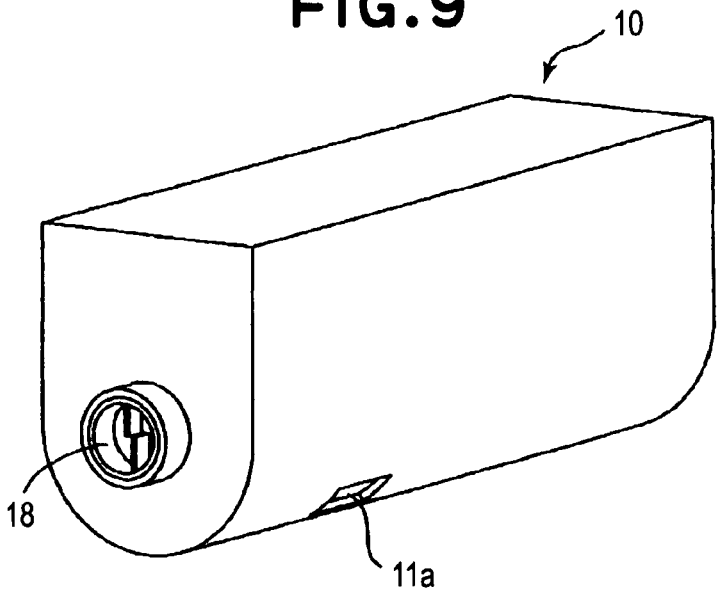
FIG. 10 is a perspective view of the developer supply container in the third embodiment of the present invention.
Figure 11:
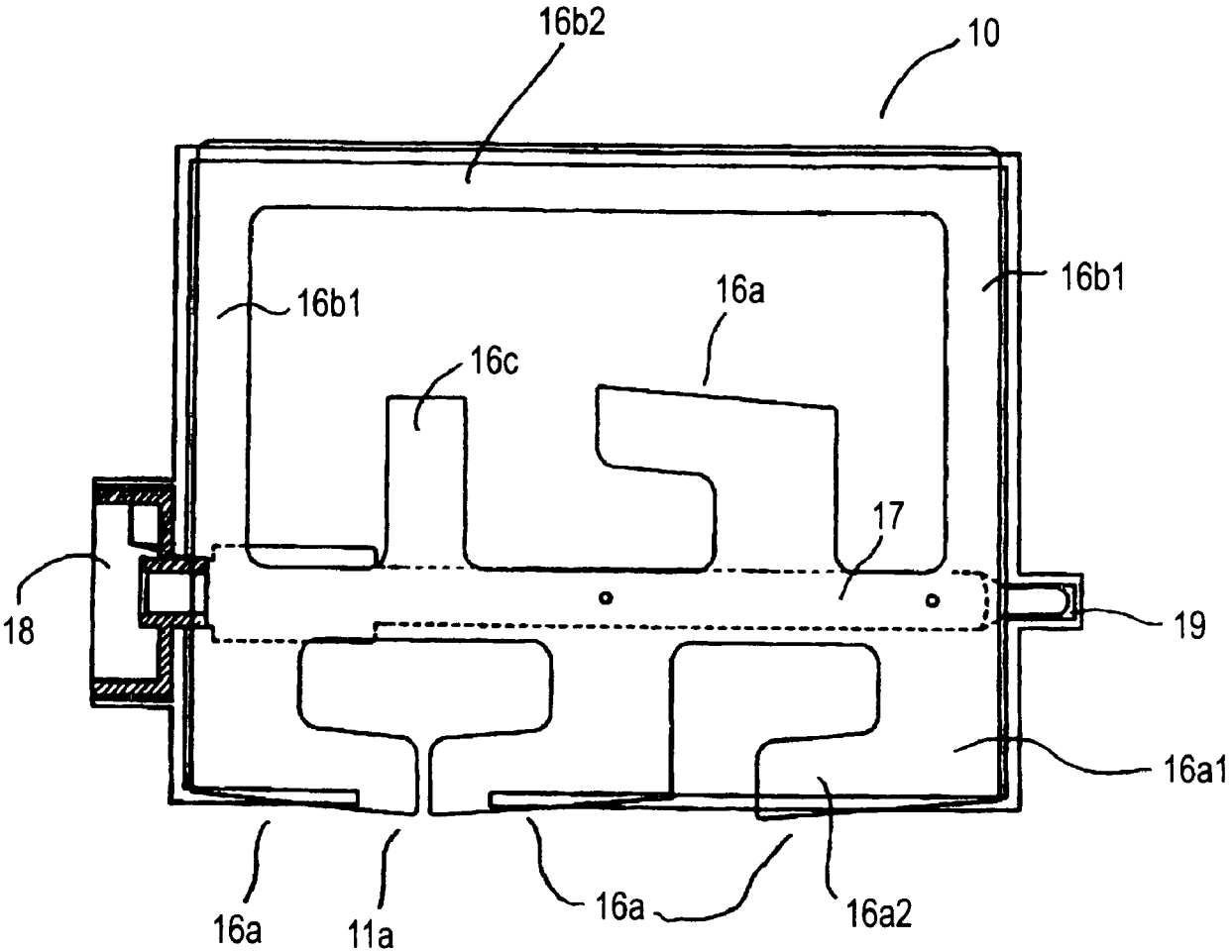
FIG. 11 is a sectional view of the developer supply container in the third embodiment of the present invention.

FIG. 10 is a perspective view of the developer supply container 10 in the third embodiment of the present invention, and FIG. 11 is a sectional view of the developer supply container 10 in FIG. 10, at a plane parallel to the rotational axis of the stirring wing support shaft 17.

The developer supply container 10 in this embodiment is an example of a developer supply container in accordance with the present invention, characterized in that due to the restrictions resulting from the design of the main assembly 100 of the image forming apparatus, the dimension of the developer supply container 10 in term of the direction parallel to the rotational axis of the stirring wing support shaft 17 is made substantial, as shown in FIGS. 10 and 11, and also, that the container proper 11 is not cylindrical.

In this embodiment, the pair of arm portions 16*b*1 of the second stirring wing 16*b* are extended from the portions of the stirring wing support shaft 17 next to the lateral walls of the container proper 11, one for one. However, if the dimension of a developer supply container, in terms of the direction parallel to the rotational axis of the stirring wing support shaft 17, is greater than that of the developer supply container 10 in this embodiment, the stirring wing of such a developer supply container may be provided with another arm which is extended from the center portion of the support shaft 17 to the connective portion 16*b*2 to reinforce the connective portion 16*b*2.

This developer supply container 10 was subjected to the experiments similar (except for the amount (roughly 500 g) of developer T with which developer supply container was filled) to those to which the developer supply container 10 in the first embodiment was subjected. The experiments showed that the developer supply container in this embodiment was equal in developer discharging performance to the developer supply container in the first embodiment. The amount of the developer T which could not be discharged from the developer supply container in this embodiment was in the range of 6.0–7.5 g (roughly 1.2–1.5% of initial amount of developer in developer supply container), which was roughly the same as the amount of the developer T which could not be discharged from the developer supply container in the first embodiment. Also in terms of the effects of the initial positioning of the stirring wing, the developer supply container in this embodiment was similar to the developer supply container in the first embodiment.

As will be evident from the foregoing description of the developer supply container in this embodiment, the employment of the above-described stirring wing 16 makes it possible to provide a developer supply container, which is substantial in the dimension in terms of the direction parallel with its stirring wing support shaft, and yet, is simple in stirring wing support shaft, and yet, is simple in stirring wing structure, inexpensive, superior in developer discharging performance, and does not produce coarse particles (toner particles).

Further, the deformation of the second wing portion 16*b* attributable to creep is prevented by setting the initial position of the second wing portion 16*b* as described above. Therefore, the possibility that the second wing portion 16*b* is adversely affected in its function is eliminated. Therefore, even if the developer T becomes compacted and stuck in certain areas of a developer supply container, it is easily loosened. In other words, this embodiment can provide a highly reliable developer supply container.

Also, this embodiment affords more latitude in designing the developer supply container 10, making it possible to more efficiently use the internal space of the image forming apparatus main assembly 100. Therefore, this embodiment greatly contributes to the effort for reducing the size of the main assembly of an image forming apparatus.

Miscellaneous

In the preceding embodiments of the present invention, the image forming apparatus was a copying machine. However, the reference to the copying machine is not intended to limit the scope of the present invention. In other words, the present invention is also applicable to an image forming apparatus other than a copying machine. For example, the present invention is also compatible with: such an image forming apparatus as a printer or facsimile machine; a multifunction image forming apparatus comprising two or more of the preceding single-function image forming apparatuses and capable of performing two or more functions thereof, an image forming apparatus which comprises a transfer medium bearing member such as a transfer belt or transfer drum for bearing and conveying a transfer medium in the form of a sheet, and sequentially transfers in layers the multiple developer image different in color, onto the transfer medium on the transfer medium bearing member; or an image forming apparatus which comprises an intermediary transferring member such as an intermediary transfer belt or an intermediary transfer drum, sequentially transfers in layers developer images different in color onto the intermediary transferring member, and then, transfers all at once the developer images on the intermediary transferring member onto the transfer medium. The effects which will be realized by the application of the present invention to the developer supply containers employed by the image forming apparatuses mentioned above will be the same as those realized by the developer supply container in the preceding embodiments.

The preceding embodiments of the present invention are not intended to limit the number of developing apparatus employable by an image forming apparatus. That is, not only is the present invention is compatible with an image forming apparatus employing only a single developing apparatus, but also, an image forming apparatus which comprises multiple developing apparatuses different in the color of the developer they use for development. In other words, the present invention is applicable regardless of the number of the developing apparatuses employed by an image forming apparatus, and the application of the present invention to such developing apparatuses will bring forth the same effects as those realized by the developer supply container in the preceding embodiments.

As described above, according to the present invention regarding the structure of a developer supply container, the following can be accomplished.

It is possible to provide a developer stirring member, which is simple in structure, and yet, is capable of conveying developer, while stirring it, without seriously damaging the developer, and also, without producing coarse particles.

Also according to the present invention, the stirring wing is initially placed in the positioned in which it will not become deformed due to creep, and in which it can easily loosen the compacted developer. Therefore, the possibility that the second wing portion will be damaged is eliminated. Therefore, it is possible to provide a developer supply container having a highly reliable stirring wing.

Also according to the present invention, more latitude is afforded in designing a developer supply container. Therefore, it is possible to provide a developer supply container which makes it possible to more efficiently use the internal space of an image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A developer supply container detachably mountable to an image forming apparatus, comprising:

a container body for accommodating a developer, said container body including an arcuate portion and an extension extending from said arcuate portion;

a discharge opening, formed in said arcuate portion for discharging the developer from said container body; and a stirring member including:

a rotation shaft provided such that a center of rotation thereof is aligned with a center of said arcuate portion;

a stirring blade, mounted on said rotation shaft, for stirring the developer in said container body, said stirring blade being of a length, which is long enough to be in contact with such a portion of an inside surface of said extension as is most remote from said center of rotation during rotation of said rotation shaft; and a feeding blade, mounted on said rotation shaft, for feeding the developer in said container body toward said discharge opening, said feeding blade being of a length, which is not long enough to contact with the most remote portion but long enough to contact with an inside surface of said arcuate portion during rotation of said shaft.

2. An apparatus according to claim 1, wherein said stirring blade includes a sliding portion slidable on said most remote portion and arm portions extending from opposite ends of said sliding portion, with respect to an axial direction of said rotation shaft, toward said rotation shaft.

3. An apparatus according to claim 2, wherein said feeding blade includes a sliding portion on the inside surface of said arcuate portion and an arm portion extending toward said rotation shaft from said sliding portion.

4. An apparatus according to claim 3, wherein each of said arm portions of said stirring blade has a width measured in the axial direction of said rotation shaft, which is smaller than a width of said arm portion of said feeding blade measured in the axial direction.

5. An apparatus according to claim 1, wherein said stirring blade and said feeding blade are made of flexible sheets.

6. An apparatus according to claim 1, wherein said stirring blade and said feeding blade are made of a single flexible sheet.

7. An apparatus according to claim 6, wherein said flexible sheet includes a plurality of such feeding blades, and an auxiliary blade disposed at a position which corresponds to a position between said feeding blades with respect to an axial direction of said rotation shaft, and which is opposite from said feeding blades relative to said rotation shaft.

8. An apparatus according to claim 6, wherein said feeding blade and said stirring blade are formed from said flexible sheet by press work.

9. An apparatus according to claim 6, wherein said flexible sheet has a hole portion for mounting on said rotation shaft between said feeding blade and said stirring blade by the press work.

10. An apparatus according to claim 5, wherein said flexible sheet is made of resin material and has a thickness of 50-500 μm.

11. An apparatus according to claim 6, wherein said flexible sheet is made of resin material and has a thickness of 50-500 μm.

* * * * *